United States Patent [19]

Fukukura et al.

[11] 4,400,596

[45] Aug. 23, 1983

[54] MEMBRANE SWITCH WITH SEQUENTIALLY CLOSABLE CONTACTS

[75] Inventors: Kazutoyo Fukukura, Reading; William J. Lynn, Groveland, both of Mass.

[73] Assignee: AMP Incorporated, Harrisburg, Pa.

[21] Appl. No.: 339,558

[22] Filed: Jan. 15, 1982

[51] Int. Cl.[3] ..... H01H 13/70

[52] U.S. Cl. ..... 200/5 A; 200/159 B

[58] Field of Search ..... 200/5 R, 5 A, 1 B, 67 DA, 200/67 DB, 159 B, 275, 302

[56] References Cited

U.S. PATENT DOCUMENTS

| | | | |
|---|---|---|---|
| 3,941,964 | 3/1976 | Yoder | 200/275 X |
| 3,996,429 | 12/1976 | Chu et al. | 200/5 A |
| 4,028,509 | 6/1977 | Zurcher | 200/5 A |
| 4,284,866 | 8/1981 | Bryce et al. | 200/159 B |

*Primary Examiner*—J. R. Scott

*Attorney, Agent, or Firm*—Frederick W. Raring

[57] ABSTRACT

Membrane switch comprises a substrate having first, second, and third switch contacts thereon. A flexible insulating film extends parallel to the substrate and has a commoning conductor on its underside. The flexible film has first and second contact projections extending towards the substrate, the first contact projection being against the first switch contact and the second contact projection being spaced from the second switch contact. A pair of supporting projections extend from the film and bear against the surface of the substrate at locations adjacent to the switch contacts. The film is supported by the first contact projection and the air of supporting projections. When the film is pressed towards the substrate, the second contact projection sequentially moves against the second switch contact and thereafter the commoning conductor is moved against the third switch contact.

9 Claims, 6 Drawing Figures

MEMBRANE SWITCH WITH SEQUENTIALLY CLOSABLE CONTACTS

FIELD OF THE INVENTION

This invention relates to membrane switches and particularly to a membrane switch in which the contacts are sequentially closed.

BACKGROUND OF THE INVENTION

U.S. Pat. No. 4,284,866 discloses a membrane switch of the single pole, double throw type comprising two super-imposed membrane switches that are closed when pressure is applied to the surface of one of the switches. The switch contacts are connected to each other in a manner which provides a single pole double throw switch. Additionally, the switch is constructed such that the switch contacts are sequentially closed in accordance with a predetermined closing sequence.

There are many circumstances where it is desirable to have membrane switches of the single pole, double throw type or related types and to provide for sequential closing of the switch contacts in order to achieve the desired result and performance in the circuits controlled by the switch. The present invention is directed to the achievement of a membrane switch having multiple switch contacts and which, upon actuation, is closed in accordance with a predetermined and predictable closing sequence. The present invention is also directed to the achievement of a switch of simplified construction which can be used as one switch on a keyboard or as an individual switch on any type of equipment for which a switch might be needed.

The invention comprises a switch of the type having an insulating substrate, a plurality of metallized switch contact on the substrate which are adjacent to each other, and a flexible sheet extending parallel to, and spaced from, one surface of the substrate. The sheet has an opposed surface which is opposed to the one surface of the substrate and has a commoning conductor on the opposed surface so that upon flexure of the sheet towards the one surface and upon engagement of the commoning conductor with the switch contacts, the switch contacts are electrically commoned. A switch in accordance with the invention is characterized in that the first surface of the substrate has first, second, and third switch contacts thereon. The flexible sheet has first and second contact projection extending from the opposed surface thereof towards the first surface of the substrate. The first contact projection is against, and is in electrical contact with, the first switch contact. The second contact projection is spaced from and in opposed relationship to the second switch contact. The commoning conductor extends over the apices of the contact projections. The flexible sheet has a pair of supporting projections extending from the opposed surface which have apices that are against the first surface of the substrate at locations spaced from the first, second, and third switch contacts. Upon application of a switch closing force to the flexible sheet at a location opposed to, and in alignment with, the third switch contact, the portion of the commoning conductor on the second contact projection is moved against the second switch contact. Thereafter, the portion of the commoning conductor which is opposed to the third switch contact is moved against the third switch contact.

In accordance with further embodiments of the invention, the flexible sheet is an insulating film and the commoning conductor comprises a metallized band on the opposed surface of the film. The third switch contact on the one surface of the substrate is between the first and second switch contacts and the flexible sheet has an outwardly formed resiliently deformable dome in alignment with the third switch contact. In accordance with further embodiments of the invention, the substrate comprises a circuit board which extends parallel to a panel member. The panel member has an opening thereon in alignment with the switch. In accordance with a still further embodiment, the switch has a switch housing mounted in the opening in the panel and the housing has a wall portion which extends transversely of the panel. The flexible sheet has marginal portions which are supported by the wall portion of the housing. In accordance with further embodiments, the housing has a switch actuator therein which is movable towards the dome to close the switch, the actuator comprising a switch button.

PREFERRED EMBODIMENT

Figure 1:
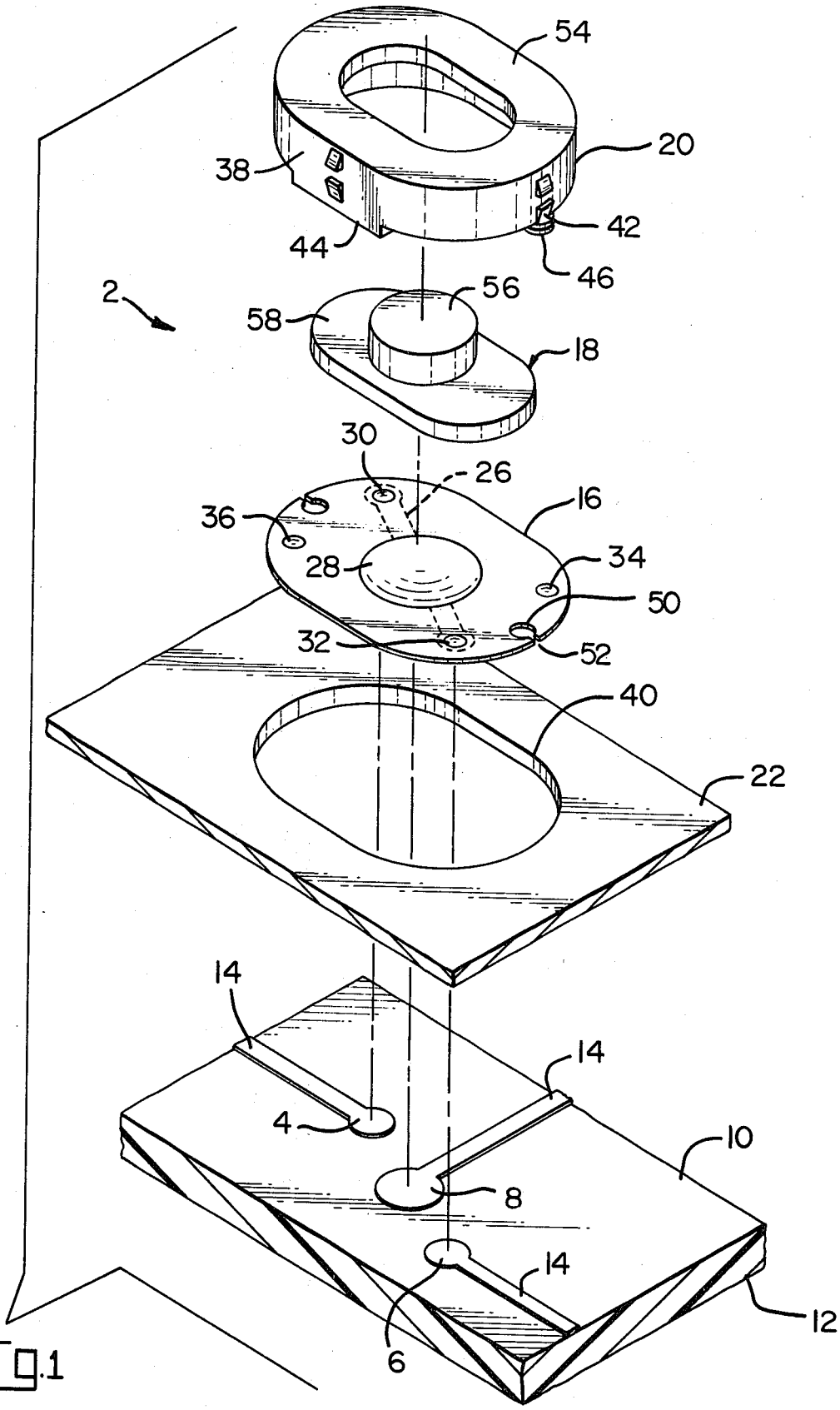
FIG. 1 is a perspective view of a switch in accordance with the invention having the parts exploded from, and in alignment with, each other.
Figure 2:
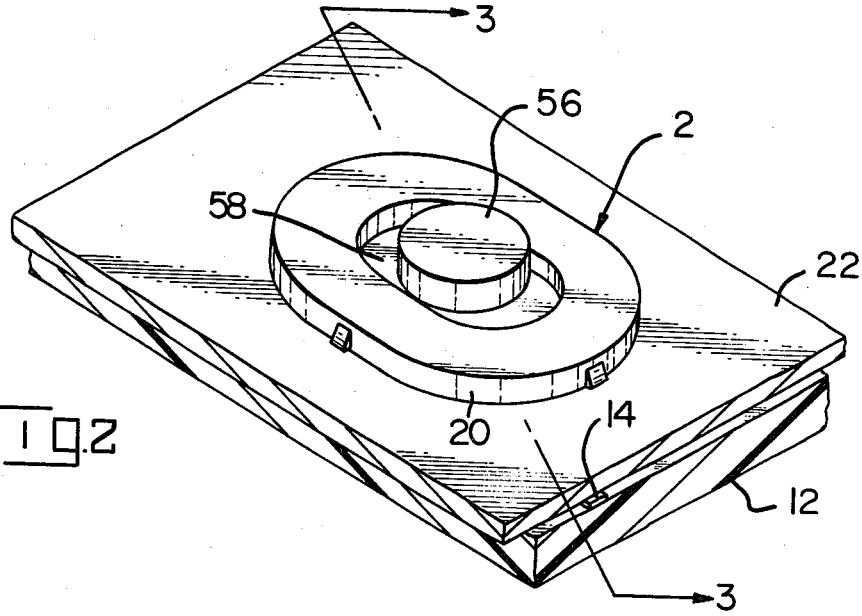
FIG. 2 is a perspective view of the assembled switch.
Figure 5:
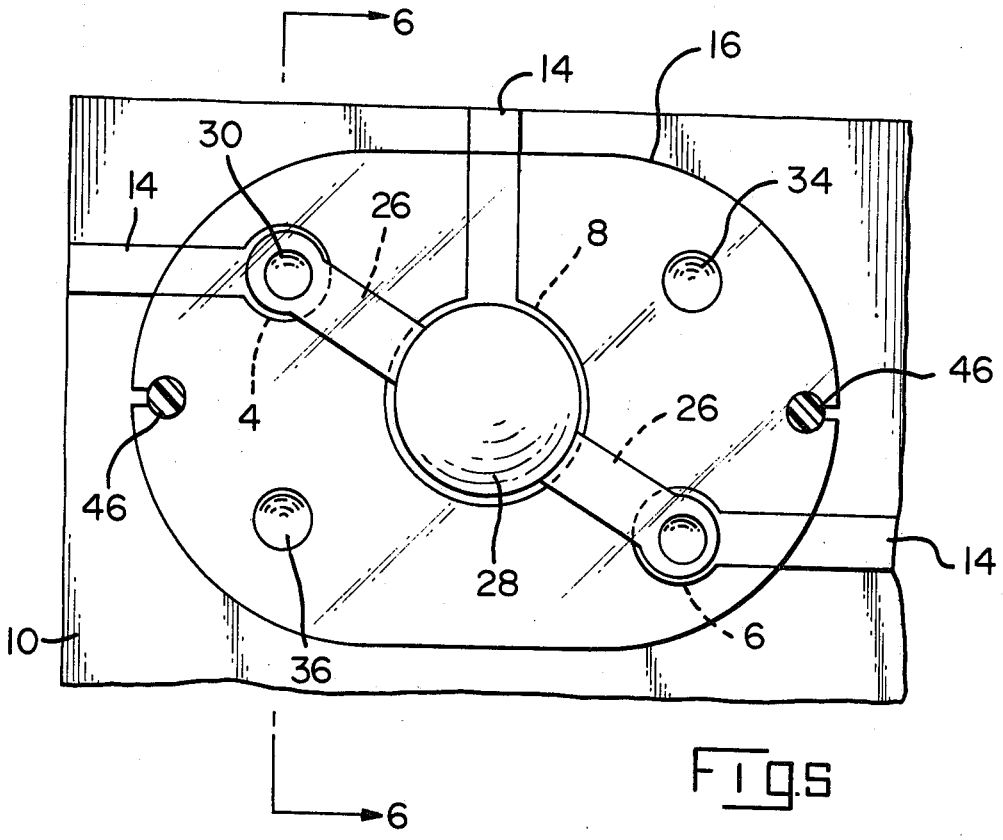
FIG. 5 is a view taken along the lines 5—5 of FIG. 3.

A switch 2 in accordance with the invention is used to provide switching between first, second, and third switch contacts 4, 6, 8 respectively, which are on the upper surface 10 of a circuit board 12. As shown in FIGS. 1 and 5, conductors 14 extend across the surface 10 from the switch contacts which lie in a straight line on the surface 10.

The switch assembly comprises a generally oval-shaped sheet of flexible film 16, an actuator 18, and a housing 20. The switch is mounted in an opening 40 and a panel 22 which extends parallel to, and is spaced from, the circuit board 12.

The film 16 is preferably of a suitable polyester material and has a lower or opposed surface 24 which is opposed to the surface 10 of the circuit board 12. The film extends generally parallel to the surface 10 and is supported in the manner described below. A commoning conductor 26 is provided on the opposed surface 24 and extends over, and in opposed relationship to, the three switch contacts 4, 6, 8. The commoning conductor may be an electrodeposited metallized material on the opposed surface 24 or a conductive ink.

The third switch contact 8 is between the first and second switch contacts 4, 6 and is somewhat enlarged, as shown in FIG. 1. The flexible sheet or film 16 has an upwardly, as viewed in the drawing, formed dome 28 which is in alignment with the third switch contact 8. As is well known in the membrane switch art, upon application of a downward force to the dome, the dome is flexible downwardly and provides a tactile sensation indicating closure of the switch.

Figure 3:
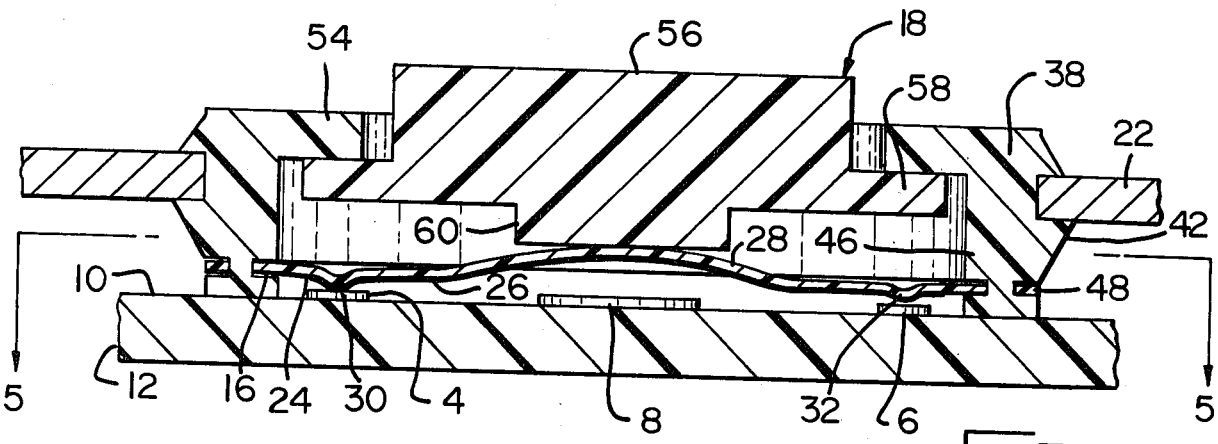
FIG. 3 is a view taken along the lines 3—3 of FIG. 2.

First and second contact projections 30, 32 are formed in the flexible sheet 16 and extend downwardly, as viewed in FIG. 3, towards the surface 10. These contact projections are in alignment with the first and second switch contacts 4, 6. In the embodiment shown, the first projection 30 is against the first contact 4 so that the commoning conductor 26 is against, and in electrical contact with the switch contact 4. The second contact projection is spaced from, but adjacent to, a second switch contact 6.

The contact projections 30, 32 and the supporting projections described below 34, 36 may be formed by embossing the film with or without the application of heat during the embossing operation.

Figure 6:
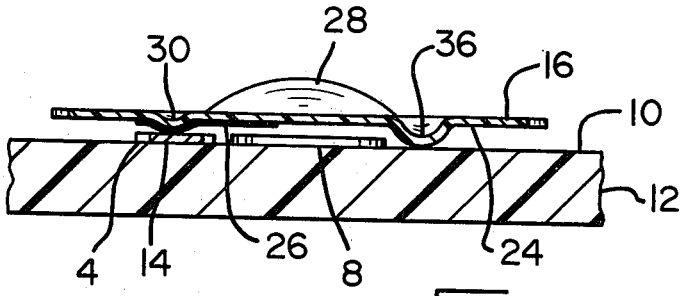
FIG. 6 is a view taken along the lines 6—6 of FIG. 5.

The supporting projections 34, 36 are on diametrically opposite sides of the dome 28 and are, as shown in Fig. 6, of a greater radius than the contact projections 30, 32. The apices of the supporting projections 34, 36 are at a greater distance, therefore, from the surface 24 of the sheet 16 than are the apices of the contact projections. The supporting projections are of the same diameter and the sheet is, as a result, supported at three locations, by the apices of the projections 34, 36, and the apex of the projection 30. As noted above, the apex of the second projection 32 is spaced from switch contact 6 and the second projection can have a slightly smaller radius than the radius of the first contact projection 30 in order to achieve this condition.

The housing 20 is a molded plastic member which is oval-shaped to conform to the oval shaped sheet 16 and opening 40. The housing has a wall 38 which extends normally of the panel and has retaining ears 42 on the external surface of the wall by means of which it is retained in the panel as shown in FIG. 3. The lower edge of the housing has diametrically opposed bearing portions 44 on the minor axis of the housing and integral support posts 46 on the major axis. The posts and the bearing portions rest on the upper surface 10 of the circuit board 12, as shown in FIG. 3.

The posts have circumferential recesses 48 adjacent to their lower ends and the sheet 16 is provided with openings 50 and slots 52 which extend from the openings to the edge of the sheet. The sheet 16 is held on the post as shown in FIG. 3 and is assembled to the post by merely passing the edge of the sheet into the recesses 48 until the reduced diameter sections of the post extend through the holes 50.

The housing has an inwardly directed flange 54 at its upper end and the actuator 18 comprises a button 56 which is disposed in the central opening defined by the flange 54. The actuator has a radially extending collar 58 that extends beneath the flange 54 and has a projection 60 on its underside which bears against the dome 28.

Figure 4:
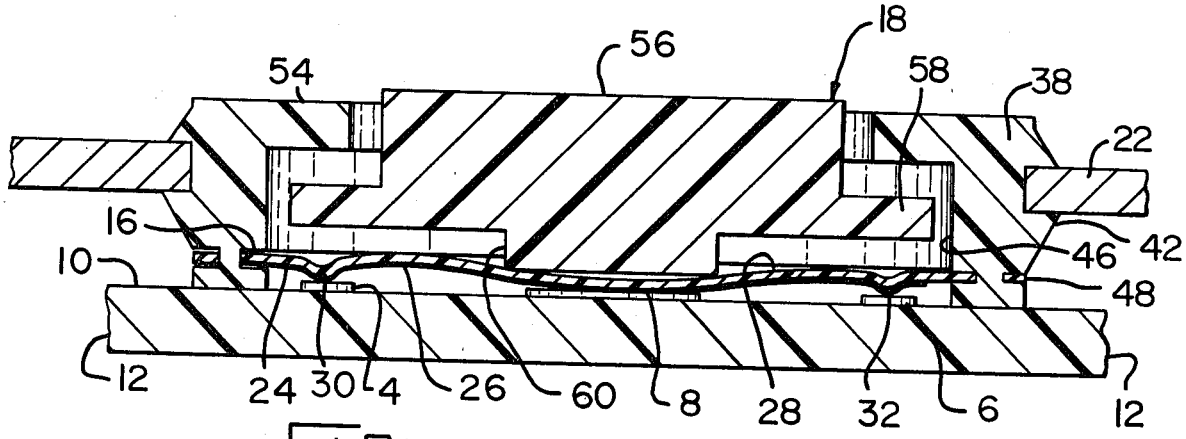
FIG. 4 is a view similar to FIG. 3, but showing the positions of the parts when the switch is closed.

When the button 56 is depressed from the position of FIG. 3 to the position of FIG. 4, the initial flexure imparted by the button to the dome 28 causes the sheet in the vicinity of the contact projection 32 to be moved downwardly thereby completing a circuit between the commoning conductor 26 and the second switch contact 6. Upon further downward movement of the button, the dome is further flexed until it assumes a concave shape and the commoning conductor is brought into contact with the third switch contact 8.

As previously mentioned, the second contact projection will be maintained out of engagement with the second switch contact 6, by virtue of the fact that the film or sheet 16 will be supported at three supporting locations. If desired, the contact projection 30 can be provided with a slightly larger radius than the contact projection 32 in order to ensure that the projection 30 will be against the first switch contact 4 and the projection 32 will be spaced from the second switch contact 6 when the parts are in position of FIG. 3. Sequential closing is achieved by virtue of the fact that a relatively slight deformation of the dome 28 will cause downward movement of the sheet 16 in the vicinity of the second contact projection 32 and thereby bring about the establishment of a circuit path from the contact 6 to the commoning conductor. Substantial deformation of the dome is required to establish contact between the commoning conductor and the third switch contact 8.

As an alternative to the use of an insulating film as the flexible sheet 16, it would be practical to form the entire sheet of thin stainless steel or other spring metal. The metallic sheet would not require metallized conductors but would otherwise be as shown in FIG. 1.

What is claimed is:

1. A switch of the type having an insulating substrate, a plurality of metallized switch contacts on one surface of the substrate, the switch contacts being adjacent to each other, a flexible sheet extending parallel to, and spaced from the one surface of said substrate, the sheet having an opposed surface which is opposed to the one surface and having a commoning conductor on the opposed surface so that upon flexure of the sheet towards the one surface and engagement of the commoning conductor with the switch contacts, the switch contacts are electrically commoned, the switch being characterized in that:

the one surface of the substrate has first, second, and third switch contacts thereon, the flexible sheet has first and second contact projections extending from the opposed surface towards the one surface of the substrate, the first contact projection being against, and in electrical contact with, the first switch contact, the second contact projection being spaced from, and in opposed relationship to, the second switch contact, the flexible sheet has a pair of supporting projections extending from the opposed surface thereof, the supporting projections having apices which are against the one surface of the substrate at locations spaced from the first, second, and third switch contacts, the flexible sheet being an insulating film, the commoning conductor comprising metallization on the opposed surface of the film whereby, upon application of a switch closing force to the flexible sheet at a location opposed to, and in alignment with, the third switch contact, the portion of the commoning conductor on the second contact projection is moved against the second switch contact, and thereafter the portion of the commoning conductor which is opposed to the third switch contact is thereafter moved against the third switch contact.

2. A switch as set forth in claim 1, characterized in that the third switch contact on the one surface is between the first and second switch contacts.

3. A switch as set forth in either of claims 1 or 2, characterized in that the flexible sheet has a resiliently deformable dome therein in alignment with the third switch contact, the dome extending in the direction away from the one surface of the substrate.

4. A switch as set forth in claim 3 characterized in that the substrate comprises a rigid circuit board.

5. A switch as set forth in claim 4 characterized in that the circuit board extends parallel to a panel member, the panel member having an opening therein in alignment with the switch.

6. A switch as set forth in claim 5 characterized in that the switch has a switch housing mounted in the opening in the panel member.

7. A switch as set forth in claim 6 characterized in that the housing has a wall portion which extends transversely of the panel member, the flexible sheet having marginal portions which are supported by the housing.

8. A switch as set forth in claim 7 characterized in that the housing has a switch actuator therein which is movable towards the third switch contact on the substrate thereby to move the flexible sheet against the third switch contact.

9. A switch as set forth in claim 8 characterized in that the actuator comprises a switch button.

* * * * *